US010946648B2

(12) United States Patent
Chen et al.

(10) Patent No.: US 10,946,648 B2
(45) Date of Patent: Mar. 16, 2021

(54) FLUID EJECTION DIE FLUID RECIRCULATION

(71) Applicant: HEWLETT-PACKARD DEVELOPMENT COMPANY, L.P., Spring, TX (US)

(72) Inventors: Chien-Hua Chen, Corvallis, OR (US); Michael W Cumbie, Corvallis, OR (US); Si-lam J Choy, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/495,456

(22) PCT Filed: May 8, 2017

(86) PCT No.: PCT/US2017/031515
§ 371 (c)(1),
(2) Date: Sep. 19, 2019

(87) PCT Pub. No.: WO2018/208276
PCT Pub. Date: Nov. 15, 2018

(65) Prior Publication Data

US 2020/0061992 A1 Feb. 27, 2020

(51) Int. Cl.
*B41J 2/14* (2006.01)
*B41J 2/18* (2006.01)
(Continued)

(52) U.S. Cl.
CPC ..... *B41J 2/14016* (2013.01); *B41J 2/18* (2013.01); *B41J 2/04541* (2013.01);
(Continued)

(58) Field of Classification Search
CPC ..... B41J 2/18; B41J 2/1404; B41J 2/14016; B41J 2/14129; B41J 2/14145; B41J 2/1433
See application file for complete search history.

(56) References Cited

U.S. PATENT DOCUMENTS 5,818,485 A 10/1998 Rezanka
6,059,399 A 5/2000 Suetsugu et al.
(Continued)

FOREIGN PATENT DOCUMENTS

CN 102036829 4/2011
CN 102985261 3/2013
(Continued)

OTHER PUBLICATIONS

New CF3 600 npi ink-recirculating inkjet printhead < Http://www.inprintshow.com/italy/exhibitor-files/toshiba-tec-s-new-cf3-inkjethead.pdf >.

*Primary Examiner* — Juanita D Jackson
(74) *Attorney, Agent, or Firm* — Dicke, Billig & Czaja, PLLC

(57) ABSTRACT

A fluid ejection device includes a fluid ejection die to eject drops of fluid and a body to support the fluid ejection die, with the fluid ejection die including a fluid ejection chamber, a drop ejecting element within the fluid ejection chamber, and a fluid feed hole communicated with the fluid ejection chamber, and with the body including a fluid feed slot communicated with the fluid feed hole of the fluid ejection die. The fluid ejection device includes a micro-recirculation system to recirculate fluid within the fluid ejection die through the fluid ejection chamber, and a macro-recirculation system to recirculate fluid within the body through the fluid feed slot across the fluid feed hole of the fluid ejection die.

13 Claims, 6 Drawing Sheets

(51) Int. Cl.
*B41J 2/045* (2006.01)
*B41J 2/175* (2006.01)

(52) U.S. Cl.
CPC ..... *B41J 2/04581* (2013.01); *B41J 2/17596* (2013.01); *B41J 2002/14467* (2013.01); *B41J 2202/12* (2013.01)

(56) References Cited

U.S. PATENT DOCUMENTS

| | | | |
|---|---|---|---|
| 6,244,694 | B1 | 6/2001 | Weber et al. |
| 6,254,214 | B1 | 7/2001 | Murthy et al. |
| 6,450,619 | B1 | 9/2002 | Anagnostopoulos et al. |
| 8,328,335 | B2 | 12/2012 | Xie et al. |
| 2010/0214380 | A1 | 8/2010 | Essen et al. |
| 2011/0128335 | A1 | 6/2011 | Von Essen et al. |
| 2012/0160925 | A1 | 6/2012 | Hoisington et al. |
| 2013/0083136 | A1* | 4/2013 | Govyadinov et al. ..... B41J 2/1404 |
| 2015/0049141 | A1 | 2/2015 | Taff et al. |
| 2015/0091989 | A1 | 4/2015 | Govyadinov |
| 2015/0124019 | A1 | 5/2015 | Cruz-Uribe et al. |
| 2015/0183227 | A1 | 7/2015 | Ishikawa |

FOREIGN PATENT DOCUMENTS

| | | |
|---|---|---|
| CN | 103753957 | 4/2014 |
| CN | 105142912 | 12/2015 |
| EP | 0666177 | 8/1995 |
| EP | 3134267 | 3/2017 |
| JP | 2011520664 | 7/2011 |
| JP | 2013059946 | 4/2013 |
| JP | 2013526441 | 6/2013 |
| JP | 2014061696 | 4/2014 |
| JP | 2014144536 A | 8/2014 |
| JP | 2014522755 | 9/2014 |
| JP | 2014237323 | 12/2014 |
| WO | WO2013002774 | 1/2013 |

* cited by examiner

FLUID EJECTION DIE FLUID RECIRCULATION

BACKGROUND

A fluid ejection die, such as a printhead die in an inkjet printing system, may use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead die and the print medium move relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
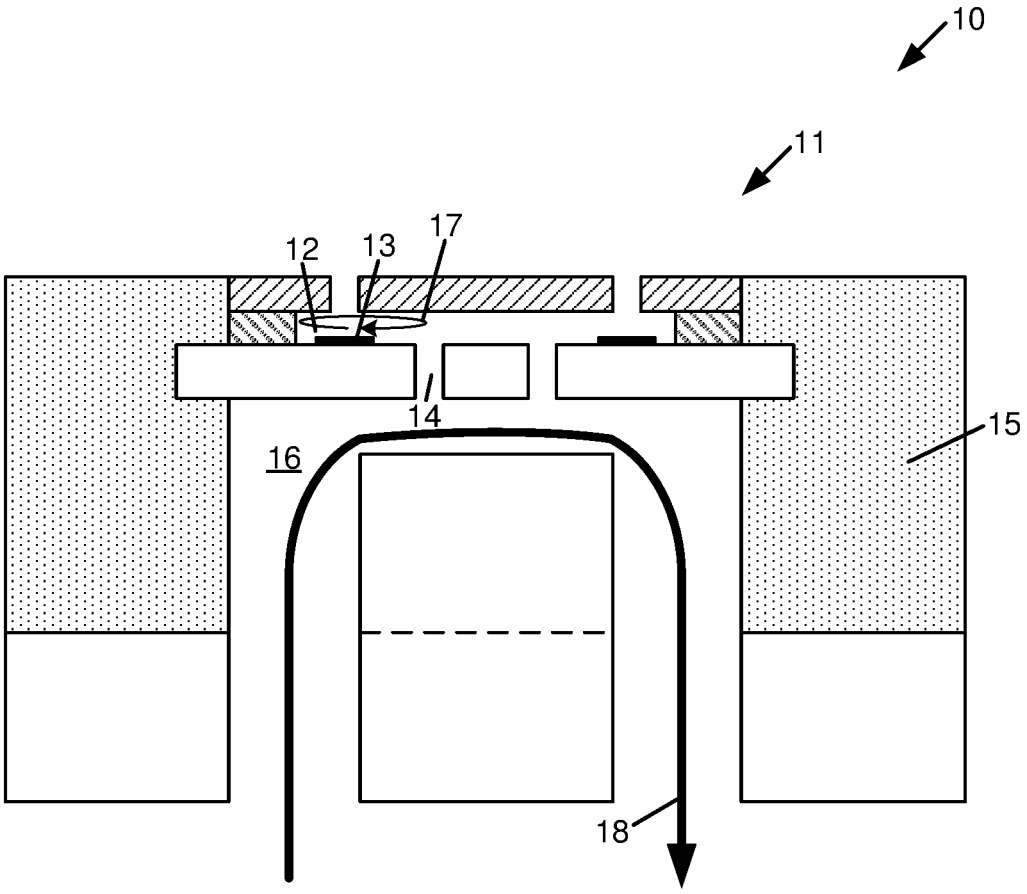
FIG. 1 is a schematic cross-sectional view illustrating an example of a portion of a fluid ejection device.

As illustrated in the example of FIG. 1, the present disclosure provides a fluid ejection device 10. In one implementation, the fluid ejection device includes a fluid ejection die 11 to eject drops of fluid and a body 15 to support the fluid ejection die, with the fluid ejection die including a fluid ejection chamber 12, a drop ejecting element 13 within the fluid ejection chamber, and a fluid feed hole 14 communicated with the fluid ejection chamber, and with the body including a fluid feed slot 16 communicated with the fluid feed hole of the fluid ejection die. In examples, the fluid ejection device includes a micro-recirculation system to recirculate fluid within the fluid ejection die through the fluid ejection chamber, as represented by arrow 17, and a macro-recirculation system to recirculate fluid within the body through the fluid feed slot across the fluid feed hole of the fluid ejection die, as represented by arrow 18.

Figure 2:
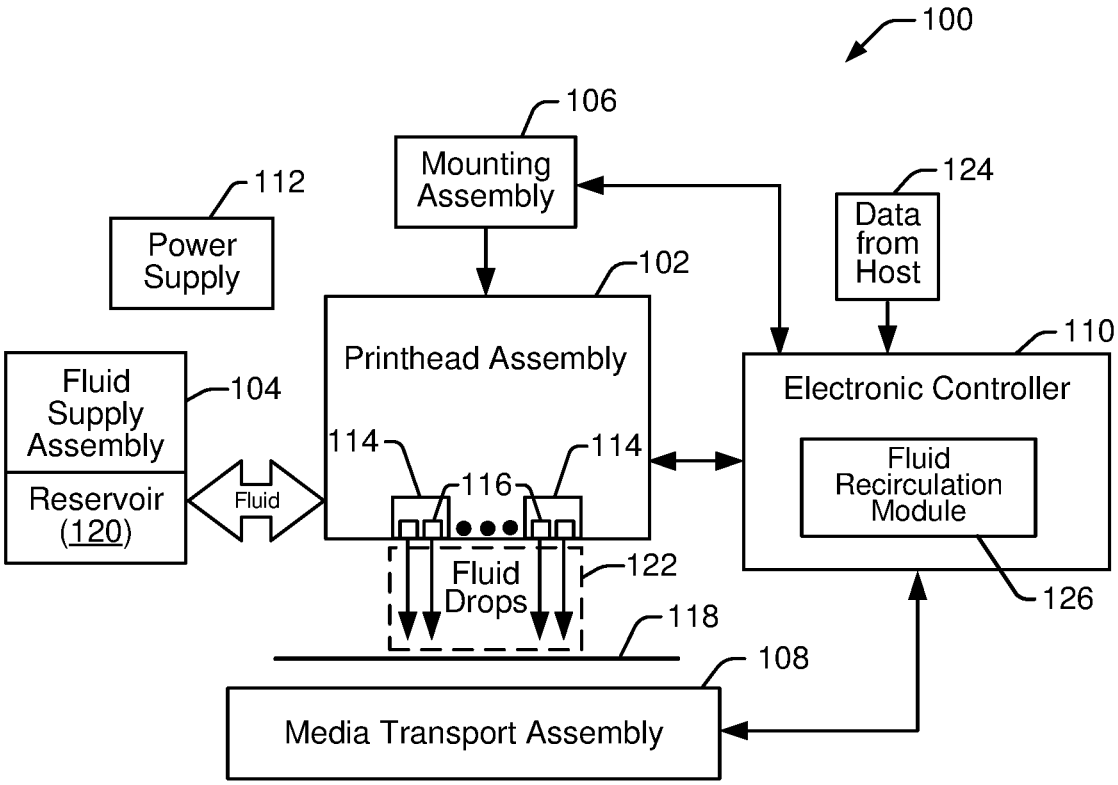
FIG. 2 is a block diagram illustrating an example of an inkjet printing system including an example of a fluid ejection device.

FIG. 2 illustrates an example of an inkjet printing system including an example of a fluid ejection device and a fluid ejection die, as disclosed herein. Inkjet printing system 100 includes a printhead assembly 102, as an example of a fluid ejection device, a fluid (ink) supply assembly 104, a mounting assembly 106, a media transport assembly 108, an electronic controller 110, and at least one power supply 112 that provides power to the various electrical components of inkjet printing system 100. Printhead assembly 102 includes at least one printhead die 114, as an example of a fluid ejection die, that ejects drops of fluid (ink) through a plurality of orifices or nozzles 116 toward a print medium 118 so as to print on print media 118.

Print media 118 can be any type of suitable sheet or roll material, such as paper, card stock, transparencies, Mylar, and the like, and may include rigid or semi-rigid material, such as cardboard or other panels. Nozzles 116 are typically arranged in one or more columns or arrays such that properly sequenced ejection of fluid (ink) from nozzles 116 causes characters, symbols, and/or other graphics or images to be printed on print media 118 as printhead assembly 102 and print media 118 are moved relative to each other.

Fluid (ink) supply assembly 104 supplies fluid (ink) to printhead assembly 102 and, in one example, includes a reservoir 120 for storing fluid such that fluid flows from reservoir 120 to printhead assembly 102. Fluid (ink) supply assembly 104 and printhead assembly 102 can form a one-way fluid delivery system or a recirculating fluid delivery system. In a one-way fluid delivery system, substantially all of the fluid supplied to printhead assembly 102 is consumed during printing. In a recirculating fluid delivery system, only a portion of the fluid supplied to printhead assembly 102 is consumed during printing. Fluid not consumed during printing is returned to fluid (ink) supply assembly 104.

In one example, printhead assembly 102 and fluid (ink) supply assembly 104 are housed together in an inkjet cartridge or pen. In another example, fluid (ink) supply assembly 104 is separate from printhead assembly 102 and supplies fluid (ink) to printhead assembly 102 through an interface connection, such as a supply tube. In either example, reservoir 120 of fluid (ink) supply assembly 104 may be removed, replaced, and/or refilled. Where printhead assembly 102 and fluid (ink) supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions printhead assembly 102 relative to media transport assembly 108, and media transport assembly 108 positions print media 118 relative to printhead assembly 102. Thus, a print zone 122 is defined adjacent to nozzles 116 in an area between printhead assembly 102 and print media 118. In one example, printhead assembly 102 is a scanning type printhead assembly. As such, mounting assembly 106 includes a carriage for moving printhead assembly 102 relative to media transport assembly 108 to scan print media 118. In another example, printhead assembly 102 is a non-scanning type printhead assembly. As such, mounting assembly 106 fixes printhead assembly 102 at a prescribed position relative to media transport assembly 108. Thus, media transport assembly 108 positions print media 118 relative to printhead assembly 102.

Electronic controller 110 typically includes a processor, firmware, software, one or more memory components including volatile and non-volatile memory components, and other printer electronics for communicating with and controlling printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one example, electronic controller 110 controls printhead assembly 102 for ejection of fluid (ink) drops from nozzles 116. Thus, electronic controller 110 defines a pattern of ejected fluid (ink) drops which form characters, symbols, and/or other graphics or images on print media 118. The pattern of ejected fluid (ink) drops is determined by the print job commands and/or command parameters.

Printhead assembly 102 includes one (i.e., a single) printhead die 114 or more than one (i.e., multiple) printhead die 114. In one example, printhead assembly 102 is a wide-array or multi-head printhead assembly. In one implementation of a wide-array assembly, printhead assembly 102 includes a carrier that carries a plurality of printhead dies 114, provides electrical communication between printhead dies 114 and electronic controller 110, and provides fluidic communication between printhead dies 114 and fluid (ink) supply assembly 104.

In one example, inkjet printing system 100 is a drop-on-demand thermal inkjet printing system wherein printhead assembly 102 includes a thermal inkjet (TIJ) printhead that implements a thermal resistor as a drop ejecting element to vaporize fluid (ink) in a fluid chamber and create bubbles that force fluid (ink) drops out of nozzles 116. In another example, inkjet printing system 100 is a drop-on-demand piezoelectric inkjet printing system wherein printhead assembly 102 includes a piezoelectric inkjet (PIJ) printhead that implements a piezoelectric actuator as a drop ejecting element to generate pressure pulses that force fluid (ink) drops out of nozzles 116.

In one example, electronic controller 110 includes a fluid recirculation module 126 stored in a memory of controller 110. Fluid recirculation module 126 executes on electronic controller 110 (i.e., a processor of controller 110) to control the operation of fluid actuators integrated as pump elements to control recirculation of fluid within printhead assembly 102, as an example of a fluid ejection device, and printhead die 114, as an example of a fluid ejection die, as described below.

Figure 3:
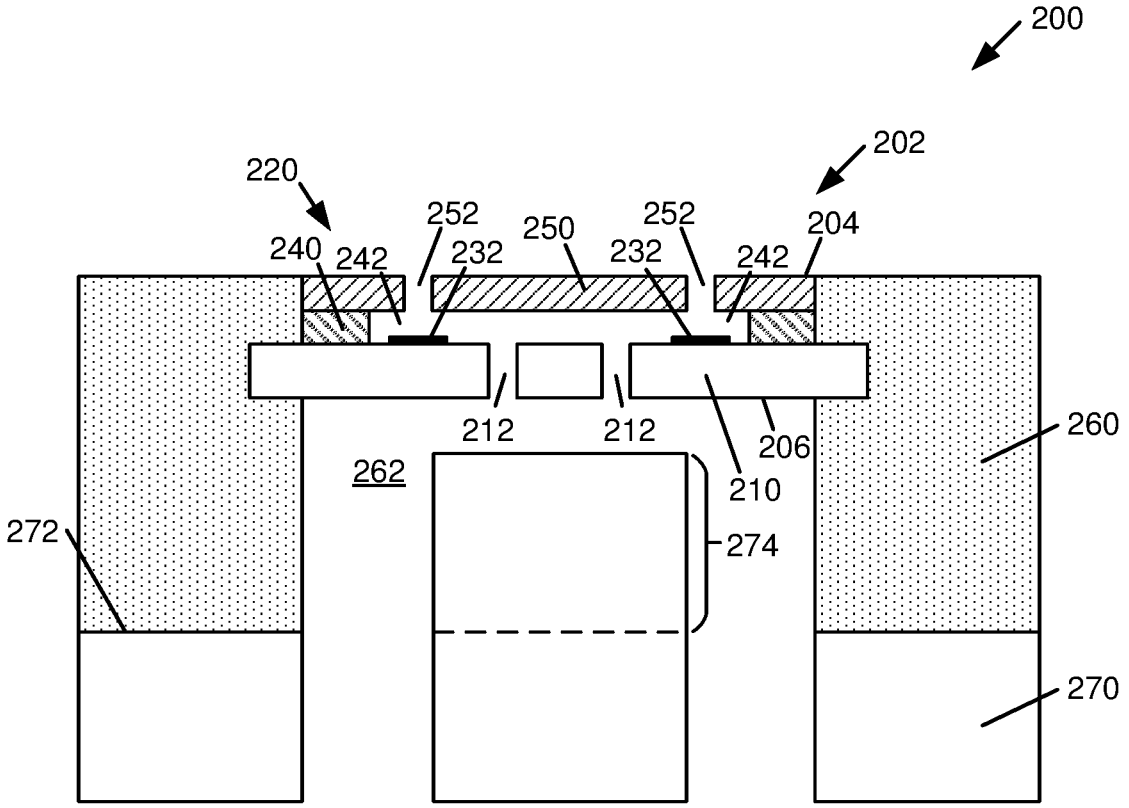
FIG. 3 is a schematic cross-sectional view illustrating an example of a portion of a fluid ejection device.

FIG. 3 is a schematic cross-sectional view illustrating an example of a portion of a fluid ejection device 200. In one implementation, fluid ejection device 200 includes a fluid ejection die 202, a body 260 supporting fluid ejection die 202, and a die carrier 270 supporting body 260.

Fluid ejection die 202 includes a substrate 210 and a fluid architecture 220 supported by substrate 210. In the illustrated example, substrate 210 has two fluid (or ink) feed holes 212 formed therein. Fluid feed holes 212 provide a supply of fluid (such as ink) to fluid architecture 220 such that fluid architecture 220 facilitates the ejection of fluid (or ink) drops from fluid ejection die 202. While two fluid feed holes 212 are illustrated, the number of fluid feed holes may vary.

In one example, substrate 210 is formed of silicon and, in some implementations, may comprise a crystalline substrate such as doped or non-doped monocrystalline silicon or doped or non-doped polycrystalline silicon. Other examples of suitable substrates include gallium arsenide, gallium phosphide, indium phosphide, glass, silica, ceramics, or a semiconducting material.

In one example, drop ejecting elements 232 are formed on substrate 210 as part of a thin-film structure (not shown). The thin-film structure includes one or more than one passivation or insulation layer formed, for example, of silicon dioxide, silicon carbide, silicon nitride, tantalum, poly-silicon glass, or other material, and a conductive layer which defines drop ejecting elements 232 and corresponding conductive paths and leads. The conductive layer is formed, for example, of aluminum, gold, tantalum, tantalum-aluminum, or other metal or metal alloy. Examples of drop ejecting elements 232 include thermal resistors or piezoelectric actuators, as described above. A variety of other devices, however, can also be used to implement drop ejecting elements 232 including, for example, a mechanical/impact driven membrane, an electrostatic (MEMS) membrane, a voice coil, a magneto-strictive drive, and others.

As illustrated in the example of FIG. 3, fluid architecture 220 is formed on or provided on substrate 210, and includes a barrier layer 240 and an orifice layer 250 such that orifice layer 250 (with orifices 252 therein) provides a first or front side 204 of fluid ejection die 202, and substrate 210 (with fluid feed holes 212 therein) provides a second or back side 206 of fluid ejection die 202.

In one example, barrier layer 240 defines a plurality of fluid ejection chambers 242 each containing a respective drop ejecting element 232. In one implementation, fluid ejection chambers 242 communicate with and receive fluid through fluid feed holes 212. Barrier layer 240 includes one or more than one layer of material and may be formed, for example, of a photoimageable epoxy resin, such as SU8.

In one example, orifice layer 250 is formed or extended over barrier layer 240 and has nozzle openings or orifices 252 formed therein. Orifices 252 communicate with respective fluid ejection chambers 242 such that drops of fluid are ejected through respective orifices 252 by respective drop ejecting elements 232. Nozzle openings or orifices 252 may be of a circular, non-circular, or other shape.

Orifice layer 250 includes one or more than one layer of material and may be formed, for example, of a photoimageable epoxy resin, such as SU8, or a nickel substrate. In some implementations, orifice layer 250 and barrier layer 240 are the same material and, in some implementations, orifice layer 250 and barrier layer 240 may be integral.

In one example, body 260 has a fluid feed slot 262 form therein. Fluid feed slot 262 provides a supply of fluid (such as ink) to fluid ejection die 202 such that fluid ejection die 202 ejects drops of fluid therefrom. In one example, body 260 is a molded body and fluid ejection die 202 is molded into body 260 with molding (i.e., forming) of body 260. As such, in one example, body 260 includes an epoxy mold compound, plastic, or other suitable moldable material.

In one example, die carrier 270 has a surface 272 with body 260 mounted on or supported by surface 272. In addition, die carrier 270 includes a feature or structure 274 that protrudes or extends beyond surface 272 such that feature or structure 274 protrudes or extends into fluid feed slot 262 of body 260. In one example, feature or structure 274 protrudes or extends toward fluid ejection die 202 including, more specifically, toward fluid feed holes 212 of fluid ejection die 202. As such, feature or structure 274 creates part of a fluid recirculation path within body 260 including, more specifically, within fluid feed slot 262 of body 260, as described below. In one implementation, feature or structure 274 is integrally formed with die carrier 270 (i.e., feature or structure 274 and die carrier 270 are of one-piece or unitary construction). In another implementation, feature or structure 274 is formed separate from and added to die carrier 270.

Figure 4:
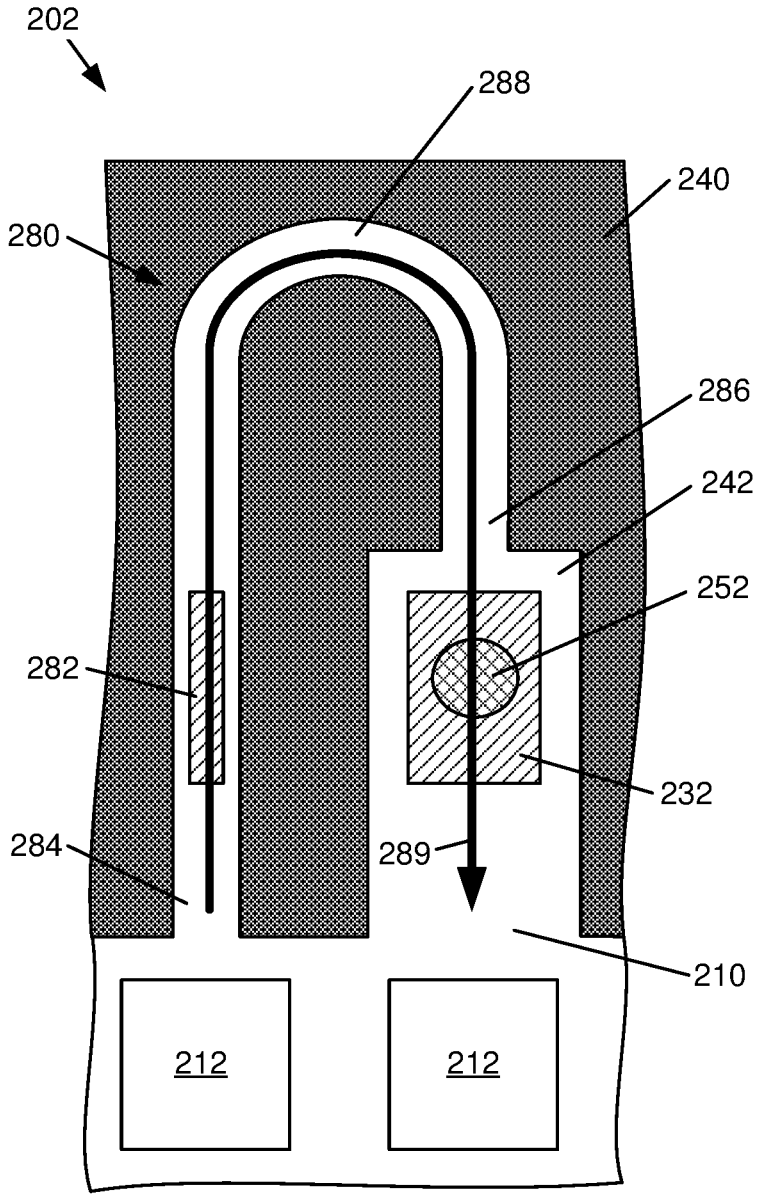
FIG. 4 is a schematic plan view illustrating an example of a portion of a fluid ejection die.

FIG. 4 is a schematic plan view illustrating an example of a portion of fluid ejection die 202. As described above, fluid ejection die 202 includes fluid ejection chamber 242 and a corresponding drop ejecting element 232 formed or provided within fluid ejection chamber 242. Fluid ejection chamber 242 and drop ejecting element 232 are formed on substrate 210 which has fluid (or ink) feed holes 212 formed therein such that one or more fluid feed holes 212 provide a supply of fluid (or ink) to fluid ejection chamber 242 and drop ejecting element 232.

In one example, as described above, fluid ejection chamber 242 is formed in or defined by barrier layer 240 provided on substrate 210. As such, fluid ejection chamber 242 provides a "well" in barrier layer 240. In addition, a nozzle or orifice layer (not shown in FIG. 4) is formed or extended over barrier layer 240 such that nozzle opening or orifice 252 formed in the orifice layer communicates with a respective fluid ejection chamber 242.

In one example, fluid ejection device 200 includes fluid recirculation. More specifically, as described below, fluid ejection device 200 includes fluid recirculation within fluid ejection die 202, as an example of micro-recirculation of fluid in fluid ejection device 200, and includes fluid recirculation within body 260 supporting fluid ejection die 202, as an example of macro-recirculation of fluid in fluid ejection device 200.

As illustrated in the example of FIG. 4, fluid ejection die 202 includes a fluid recirculation path or channel 280 and a fluid recirculating element 282 formed in, provided within, or communicated with fluid recirculation channel 280. In one example, fluid recirculation channel 280 is open to and communicates at one end 284 with fluid feed holes 212 and communicates at another end 286 with fluid ejection chamber 242 such that fluid from fluid feed holes 212 recirculates (or circulates) through fluid recirculation channel 280 and through fluid ejection chamber 242 based on flow induced by fluid recirculating element 282. In one example, fluid recirculation channel 280 includes a U-shaped channel loop portion 288 with end 286 of fluid recirculation channel 280 communicated with an end wall of fluid ejection chamber 242.

As illustrated in the example of FIG. 4, fluid recirculation channel 280 communicates with one (i.e., a single) fluid ejection chamber 242. As such, fluid ejection die 202 has a 1:1 nozzle-to-pump ratio, where fluid recirculating element 282 is referred to as a "pump" which induces fluid flow through fluid recirculation channel 280 and fluid ejection chamber 242. With a 1:1 ratio, recirculation is individually provided for each fluid ejection chamber 242. In other examples, fluid recirculation channel 280 communicates with multiple fluid ejection chambers 242 such that fluid recirculating element 282 induces fluid flow through multiple fluid ejection chambers 242. As such, other nozzle-to-pump ratios (e.g., 2:1, 3:1, 4:1, etc.) are possible.

In the example illustrated in FIG. 4, drop ejecting element 232 and fluid recirculating element 282 are both thermal resistors. Each of the thermal resistors may include, for example, a single resistor, a split resistor, a comb resistor, or multiple resistors. A variety of other devices, however, can also be used to implement drop ejecting element 232 and fluid recirculating element 282 including, for example, a piezoelectric actuator, an electrostatic (MEMS) membrane, a mechanical/impact driven membrane, a voice coil, a magneto-strictive drive, and other.

In one example, fluid recirculation channel 280 and fluid recirculating element 282, as illustrated in the example of FIG. 4, form part of a micro-recirculation system to recirculate fluid within fluid ejection die 202 of fluid ejection device 200. More specifically, fluid from one or more fluid feed holes 212 is recirculated within fluid ejection die 202 through fluid recirculation channel 280 and through fluid ejection chamber 242, as schematically represented by arrow 289. As such, fluid recirculation channel 280 and fluid recirculating element 282, as part of a micro-recirculation system, are internal to fluid ejection die 202 and recirculate fluid as supplied to fluid ejection die 202 through fluid feed hole 212.

Figure 5:
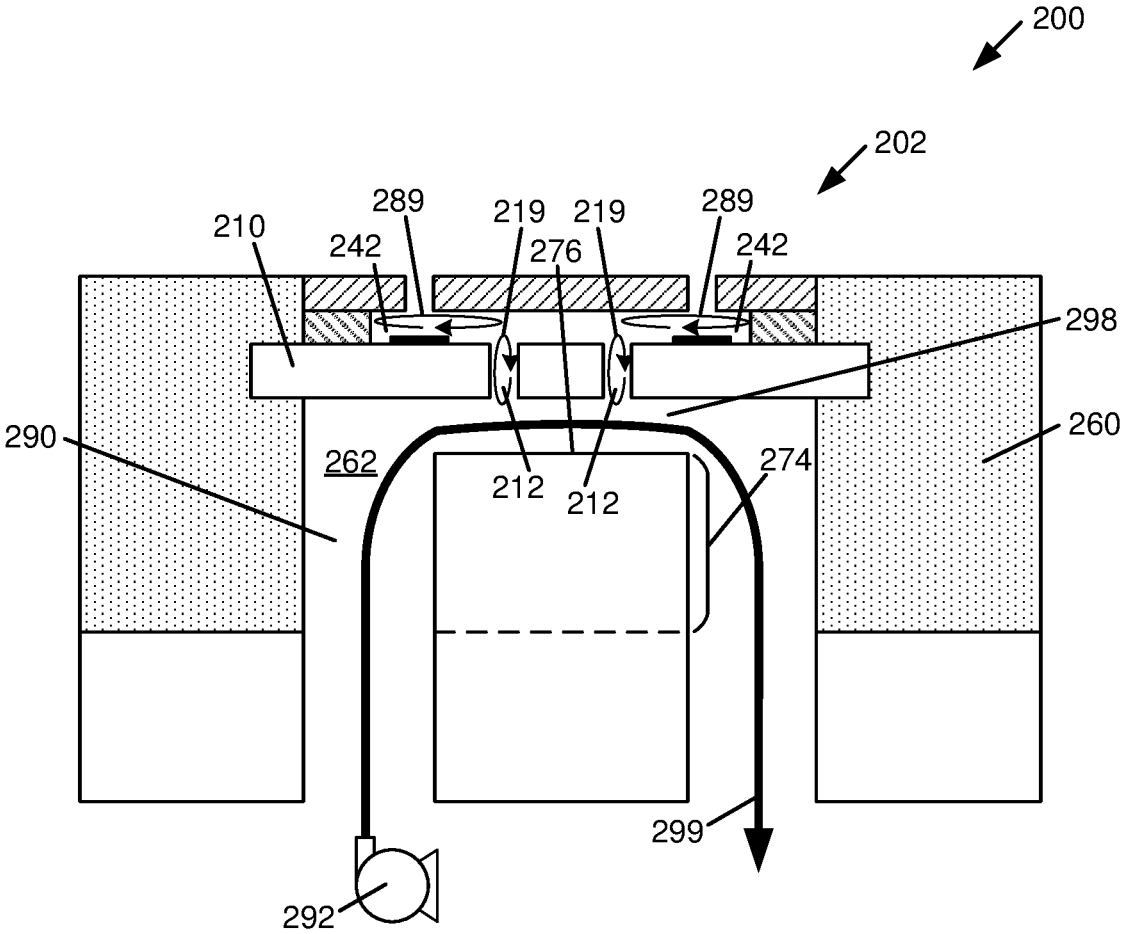
FIG. 5 is a schematic cross-sectional view illustrating an example of fluid recirculation in a fluid ejection device.

As illustrated in the example of FIG. 5, fluid ejection device 200 includes a fluid recirculation path or channel 290 and a fluid recirculating element 292, schematically illustrated as a fluid pump. In one example, fluid recirculation channel 290 is formed within body 260 including, more specifically, within fluid feed slot 262 of body 260 such that fluid within fluid feed slot 262 recirculates (or circulates) through fluid recirculation channel 290 based on flow induced by fluid recirculating element 292. In one example, fluid recirculation channel 290 includes a channel loop portion 298 around an end surface or end 276 of structure 274. As such, fluid recirculation channel 290 recirculates fluid around end surface or end 276 of structure 274 and through a space provided between end surface or end 276 of structure 274 and substrate 210 (with fluid feed holes 212 therein). With structure 274 protruded into fluid feed slot 262 and toward fluid feed holes 212, fluid recirculation channel 290 is located close (or closer) to fluid feed holes 212.

In one example, fluid recirculation channel 290 and fluid recirculating element 292, as illustrated in the example of FIG. 5, form part of a macro-recirculation system to recirculate fluid within body 260 of fluid ejection device 200. More specifically, fluid within fluid feed slot 262 is recirculated within body 260 through fluid feed slot 262 and across fluid feed holes 212 of fluid ejection die 202, as schematically represented by arrow 299. As such, fluid recirculation channel 290 and fluid recirculating element 292, as part of a macro-recirculation system, are external to fluid ejection die 202 and recirculate fluid to and from fluid feed holes 212.

FIG. 5 schematically illustrates an example of fluid recirculation in fluid ejection device 200. As described above, fluid ejection device 200 includes micro-recirculation of fluid and macro-recirculation of fluid. More specifically, fluid is recirculated within fluid ejection die 202 through fluid ejection chamber (or chambers) 242, as schematically represented by arrow 289 (and further illustrated in FIG. 4). In addition, fluid is recirculated within body 260 through fluid feed slot 262 and across fluid feed hole (or holes) 212 of fluid ejection die 202, as schematically represented by arrow 299. As such, in one example, fluid recirculation within fluid ejection die 202 and fluid recirculation within body 260 cooperate or interact to recirculate (or circulate) fluid through fluid feed hole (or holes) 212, as schematically represented by arrow 219. While fluid recirculation is illustrated as being in a clockwise direction in the example of FIG. 5, fluid recirculation may be in a different direction or combination of directions.

Figure 6:
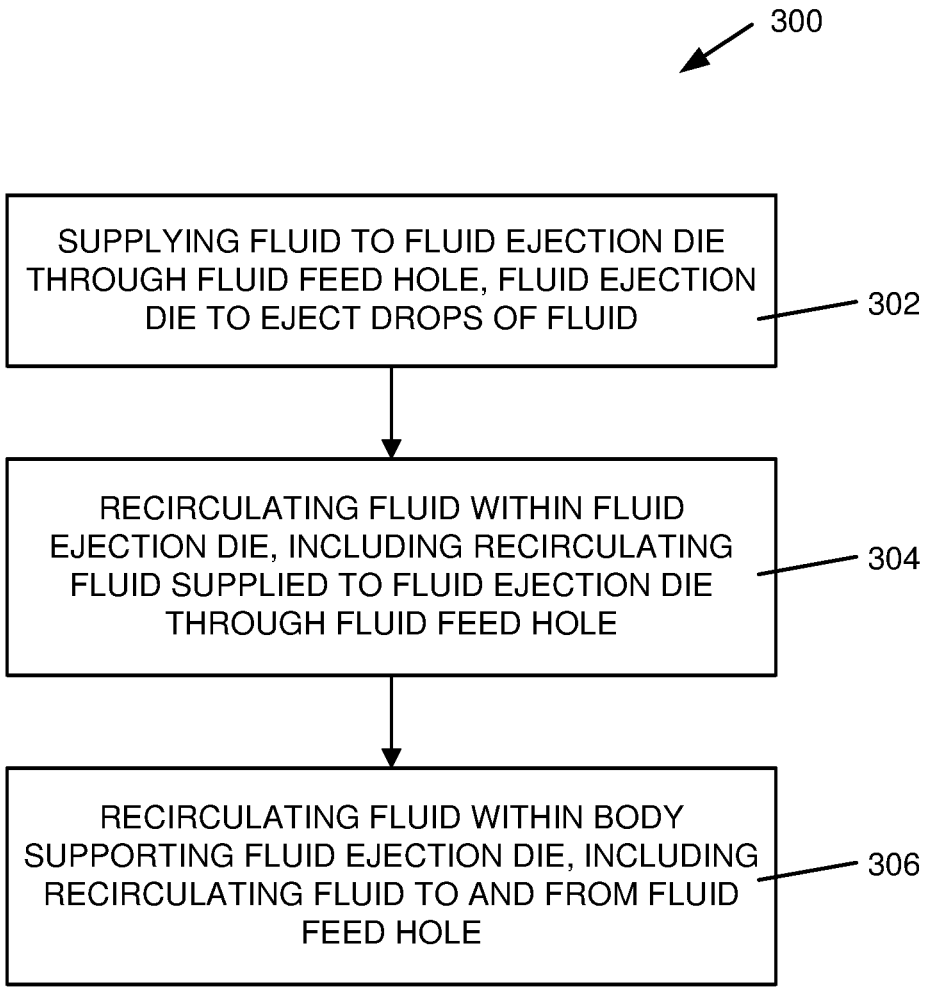
FIG. 6 is a flow diagram illustrating an example of a method of operating a fluid ejection device.

FIG. 6 is a flow diagram illustrating an example of a method 300 of operating a fluid ejection device, such as fluid ejection device 200, as illustrated in the examples of FIGS. 3, 4, 5.

At 302, method 300 includes supplying fluid to a fluid ejection die through a fluid feed hole, where the fluid ejection die is to eject drops of the fluid, such as supplying fluid to fluid ejection die 202 through fluid feed hole (or holes) 212.

At 304, method 300 includes recirculating fluid within the fluid ejection die, including recirculating fluid supplied to the fluid ejection die through the fluid feed hole, such as recirculating fluid, as supplied to fluid ejection die 202 through fluid feed hole (or holes) 212, within fluid ejection die 202.

And, at 306, method 300 includes recirculating fluid within a body supporting the fluid ejection die, including recirculating fluid to and from the fluid feed hole, such as recirculating fluid, to and from fluid feed hole (or holes) 212, within body 260 supporting fluid ejection die 202.

As described herein, fluid ejection device 200 includes fluid recirculation within fluid ejection die 202, as an example of micro-recirculation of fluid in fluid ejection device 200, and includes fluid recirculation within body 260 supporting fluid ejection die 202, as an example of macro-recirculation of fluid in fluid ejection device 200. More specifically, the micro-recirculation of fluid in fluid ejection device 200 recirculates fluid as supplied to fluid ejection die 202 through fluid feed hole (or holes) 212, and the macro-recirculation of fluid in fluid ejection device 200 recirculates fluid within body 260 supporting fluid ejection die 202 to and from fluid feed hole (or holes) 212.

With structure 274 of die carrier 270 protruded into fluid feed slot 262 and toward fluid feed holes 212, fluid recirculation within body 260 is located close (or closer) to fluid feed holes 212. As such, in one example, fluid recirculation within fluid ejection die 202 and fluid recirculation within body 260 together recirculate fluid through fluid feed hole (or holes) 212. Thus, with fluid recirculation within fluid ejection die 202, as described herein, ink blockage and/or clogging is reduced such that decap time and, therefore, nozzle health is improved. In addition, pigment-ink vehicle separation and viscous ink plug formation are reduced or eliminated. Furthermore, with fluid recirculation within body 260, as described herein, transfer of waste heat build-up in substrate 210 of fluid ejection die 202 is improved.

Example fluid ejection devices, as described herein, may be implemented in printing devices, such as two-dimensional printers and/or three-dimensional printers (3D). As will be appreciated, some example fluid ejection devices may be printheads. In some examples, a fluid ejection device may be implemented into a printing device and may be utilized to print content onto a media, such as paper, a layer of powder-based build material, reactive devices (such as lab-on-a-chip devices), etc. Example fluid ejection devices include ink-based ejection devices, digital titration devices, 3D printing devices, pharmaceutical dispensation devices, lab-on-chip devices, fluidic diagnostic circuits, and/or other such devices in which amounts of fluids may be dispensed/ejected.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. A fluid ejection device, comprising:

a fluid ejection die to eject drops of fluid, the fluid ejection die including a fluid ejection chamber, a drop ejecting element within the fluid ejection chamber, and a fluid feed hole communicated with the fluid ejection chamber;

a body to support the fluid ejection die, the body including a fluid feed slot communicated with the fluid feed hole of the fluid ejection die; and a structure protruded into the fluid feed slot of the body toward the fluid feed hole of the fluid ejection die;

the fluid ejection device to recirculate fluid within the fluid ejection die through the fluid ejection chamber; and the fluid ejection device to recirculate fluid within the body through the fluid feed slot around an end of the structure protruded toward the fluid feed hole and across the fluid feed hole.

2. The fluid ejection device of claim 1, the fluid feed hole to supply fluid to the fluid ejection die, the fluid ejection device to recirculate fluid as supplied to the fluid ejection die through the fluid feed hole, and the fluid ejection device to recirculate fluid to and from the fluid feed hole.

3. The fluid ejection device of claim 1, further comprising:

a die carrier to support the body, the die carrier including the structure protruded into the fluid feed slot of the body toward the fluid feed hole of the fluid ejection die.

4. The fluid ejection device of claim 1, the fluid ejection device to recirculate fluid through the fluid feed hole.

5. A fluid ejection device, comprising:

a die carrier;

a body supported by the die carrier;

a fluid ejection die supported by the body;

the body having a fluid feed slot formed therein;

the fluid ejection die including a fluid ejection chamber, a drop ejecting element within the fluid ejection chamber, and a fluid feed hole communicated with the fluid ejection chamber and the fluid feed slot;

the die carrier including a structure protruded into the fluid feed slot toward the fluid feed hole;

a first fluid-recirculation path through the fluid ejection chamber of the fluid ejection die;

a second fluid-recirculation path around the protruded structure of the die carrier.

6. The fluid ejection device of claim 5, further comprising:

a first fluid-recirculating element communicated with the first fluid-recirculation path.

7. The fluid ejection device of claim 5, further comprising:

a second fluid-recirculating element communicated with the second fluid-recirculation path.

8. The fluid ejection device of claim 5, wherein the body comprises a molded body, wherein the fluid ejection die is molded into the molded body.

9. The fluid ejection device of claim 5, wherein the protruded structure is integrally formed with the die carrier.

10. The fluid ejection device of claim 5, wherein the protruded structure is added to the die carrier.

11. A method of operating a fluid ejection device, comprising:

supplying fluid to a fluid ejection die through a fluid feed hole, the fluid ejection die to eject drops of the fluid;

recirculating fluid within the fluid ejection die, including recirculating fluid supplied to the fluid ejection die through the fluid feed hole; and recirculating fluid within a body supporting the fluid ejection die, including recirculating fluid to and from the fluid feed hole through a fluid feed slot formed in the body, including recirculating fluid around an end of a structure protruded into the fluid feed slot toward the fluid feed hole.

12. The method of claim 11, wherein recirculating fluid within the fluid ejection die includes recirculating fluid through a fluid ejection chamber of the fluid ejection die.

13. The method of claim 11, wherein recirculating fluid within the fluid ejection die and recirculating fluid within the body together provide recirculating fluid through the fluid feed hole.

* * * * *